United States Patent [19]

Cser et al.

[11] 4,352,342

[45] Oct. 5, 1982

[54] AUTOMATIC VENTILATION APPARATUS FOR LIQUID SYSTEMS WITH FORCED FLOW

[75] Inventors: Gyula Cser; Árpád Pataki, both of Budapest, Hungary

[73] Assignee: Autoipari Kutato Intezet, Budapest, Hungary

[21] Appl. No.: 98,510

[22] Filed: Nov. 29, 1979

[30] Foreign Application Priority Data

Nov. 30, 1978 [HU] Hungary ..... AU 414

[51] Int. Cl.[3] ..... F01P 3/22

[52] U.S. Cl. ..... 123/41.54; 123/41.29; 165/104.32; 55/191; 55/192; 55/190; 55/189

[58] Field of Search ..... 123/41.29, 41.54; 165/104.32, 104.27; 55/189, 190, 191, 192

[56] References Cited

U.S. PATENT DOCUMENTS

| | | | |
|---|---|---|---|
| 2,262,659 | 11/1941 | Ware | 123/41.29 X |
| 2,841,127 | 7/1958 | Baster | 123/41.29 X |
| 3,425,400 | 2/1969 | Scherenberg | 123/41.29 X |
| 4,049,047 | 9/1977 | Keen | 123/41.29 X |
| 4,200,065 | 4/1980 | Buddenhagen | 123/41.54 |

FOREIGN PATENT DOCUMENTS

| | | | |
|---|---|---|---|
| 2062381 | 6/1972 | Fed. Rep. of Germany | 123/41.54 |

*Primary Examiner*—Albert W. Davis
*Attorney, Agent, or Firm*—Karl F. Ross

[57] ABSTRACT

An engine-cooling system has each of the vent pipes connecting a geodetic high point with the expansion tank provided with a hydrodynamic flow-controlling throttle which provides substantially unobstructed flow to air and provides increasing flow resistance with increasing liquid flow throughput of the coolant-circulating pump.

3 Claims, 5 Drawing Figures

AUTOMATIC VENTILATION APPARATUS FOR LIQUID SYSTEMS WITH FORCED FLOW

FIELD OF THE INVENTION

The invention relates to an automatic venting apparatus for liquid systems with forced flow, especially for the cooling system of combustion engines.

BACKGROUND OF THE INVENTION

The cooling systems of liquid-cooled combustion engines in vehicles are usually closed positive-pressure systems, comprising an expansion tank. This expansion tank has to fulfil several important tasks: it must compensate for the volume changes resulting from the temperature changes of the cooling liquid, it must collect the air present in the liquid system, and it must prevent excessive depression or cavitation in front of the pump. These expansion tanks are installed in parallel with the main liquid circuit. The expansion tank is so connected that the vent pipe, starting from the highest geodetic point of the cooling system, discharges into the expansion tank and the fall pipe from the expansion tank is connected immediately ahead of the pump intake of the liquid pump. This arrangement is known primarily with utility vehicles but is not completely satisfactory. The compensation of volume changes does not create any difficulties; it is sufficient to maintain a certain container volume and a certain liquid level. In the simplest automatic venting system a permanent connection is provided between the main liquid circuit and the expansion tank via the vent tubes. The air segregated at the geodetic high points of the liquid circuit can move uninhibited into the expansion tank. In cooling circuits with a single geodetic high point the venting process can be accellerated by a centrifugal separator described as in the British Pat. No. 1,497,988, which is advantageously placed at the geodetic high point of the main liquid circuit. Since in most cases it is required to vent at several geodetic high points, the applicability of such centrifugal separators is limited because the installation of several of these units creates high flow resistance with the relatively large amounts of liquid flowing through the ventilation pipes. Therefore, in the case of several geodetic high points a vent pipe runs from each high point to the expansion tank. Advantageously, the inner diameter of the ventilation pipe is made as large as possible, first because of the danger of clogging by impurities and scale deposits, and second to provide sufficiently rapid ventilation. Since during the functioning of the engine various different pressures will prevail at the several geodetic high points the vent pipes practically have to be individually connected to the expansion tank. Thus the amount of liquid flowing into the expansion tank can rise to such an extent that an unduly high liquid velocity in the fall pipe is necessary. In order to maintain this rapid liquid flow in the fall pipe, a large static pressure differential is required, such that it could be larger than the static pressure difference resulting from the level distance between the level of the liquid in the expansion tank and at the connection point of the fall pipe in front of the liquid pump. In this case the expansion tank becomes ineffective as a means for maintaining the static overpressure in front of the impeller of the liquid pump, thereby resulting in vapor formation and cavitation.

Technical solutions are known for overcoming the contradictory requirements of venting and of maintaining a desired static pressure at the pump.

The simplest solution is the installation of a closure construction (valve, cock etc.) in the vent pipe. With this closure construction the flow of liquid in the pipes or the expansion tank, respectively, can be interrupted after the ventilation, and in the immediate vicinity of the intake pipe of the liquid pump a static pressure can be achieved, which is larger than the pressure prevailing in the vapor space of the expansion tank and larger than the pressure resulting from the liquid level difference already mentioned. The solution has the disadvantage of requiring action by the human being and improper handling results in the possibility that air remains in the liquid system, which with nonstationary operation can cause cavitation, and reduce on the water side the circulated amount of liquid and the heat transfer. When the closures remain open the first-mentioned problem remains unchanged.

These disadvantages can be avoided in accordance with the technique described in German Patent DE-PS No. 1,931,918 by providing only a portion of the venting lines with manual closure constructions, whereas in the other portion the continuous liquid flow parallel to the main circuit through the expansion tank is assured. This apparatus is not automatic; it requires intervention by man.

It is furthermore disadvantageous that even after closure of the valve a considerable amount of liquid circulates and furthermore that a part of the air, which accumulates after the filling of the system with liquid during the engine operation, remains in the system because of the closed valve. In order to clear this, the motor has to be stopped, the valve has to be opened again, and the missing liquid has to be added. Only after these procedures have been repeated several times is the desired filling state achieved, and this depends to a large extent on the skill of the person performing the venting.

OBJECT OF THE INVENTION

It is an object of the invention to provide an automatic ventilation apparatus which is more advantageous than the earlier systems described, is generally applicable and takes little space and which both during filling as well as during operation of the engine vents automatically while assuring a sufficient overpressure in the line ahead of the liquid pump.

SUMMARY OF THE INVENTION

This is achieved according to the present invention by incorporating in the vent pipe discharging into the expansion tank a reducing element for the hydraulic cross-section ($\mu f$) characteristic for its transmission of liquid and active only during the forced flow generated by the liquid pump of the cooling circuit.

The invention thus provides an automatic ventilation apparatus for liquid systems with forced flow, especially for the cooling system of a liquid-cooled combustion engines in automotive vehicles having several geodetic high points, wherein the vent pipe beginning at a geodetic high point of the liquid circuit is connected to an expansion tank and the tank is connected by a fall pipe to the intake pipe of the liquid pump. It is characteristic of the ventilation apparatus of the present invention, that the ventilation pipe has a reducing element for the hydraulic cross-section ($\mu f$) characteristic for its liquid transmission which is active exclusively during the forced flow generated by the liquid pump of the cooling circuit.

According to a preferred embodiment of the invention the element reducing the hydraulic cross-section, i.e. the variable throttle or constriction, is formed as a container with constant geometrical cross-section and a cylindrical interior with an insert generating a liquid vortex. In accordance with another advantageous embodiment of the invention the element reducing the hydraulic cross-section is formed as an automatic valve with variable geometric cross-section, wherein a decreased geometrical cross-section is coordinated to an increased throughput of the liquid pump.

The most remarkable property of the throttle element installed in the ventilation pipe in accordance with the present invention is in view of practical operations however that the geometric cross-section of the throttle element is identical with that of the vent pipe, which results in the advantage that scale deposits are not to be expected, that filling does not cause a particular resistance and that nevertheless an increased throttle effect is generated during the forced flow generated by the liquid pump. In cooling circuits provided with several geodetical high points several ventilation pipes can be connected to a single, liquid vortex-generating throttle element reducing the hydraulic cross-section.

SPECIFIC DESCRIPTION

Figure 1:
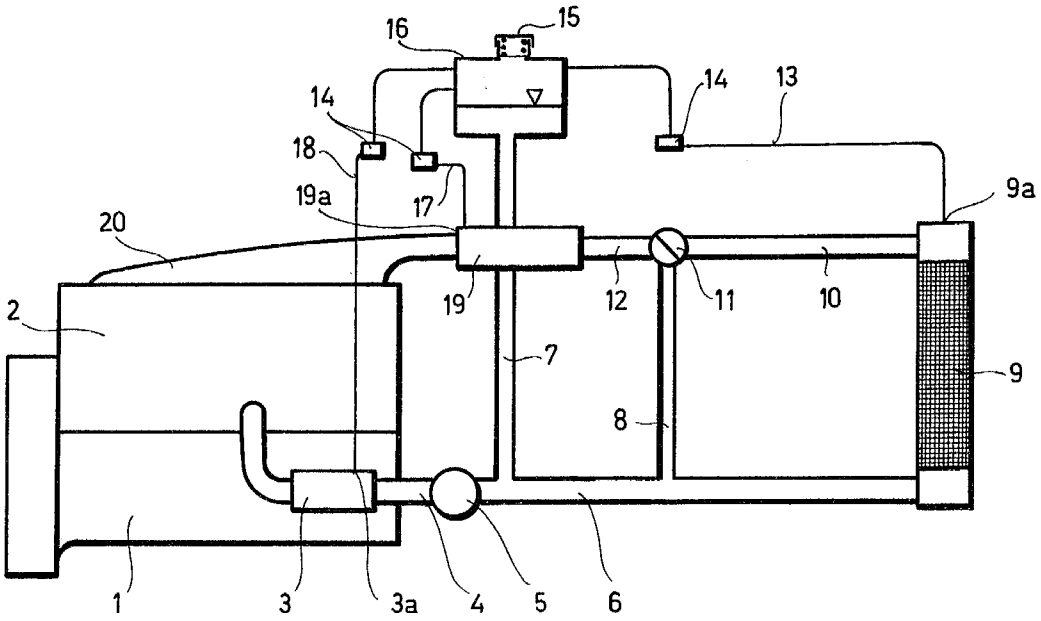
FIG. 1 schematically shows the cooling circuit of a liquid-cooled combustion engine.

FIG. 1 shows the cooling circuit of a liquid cooled combustion engine in a schematic representation. The main circuit of the cooling system of the combustion engine 1 is formed by the following components: an oil cooler 19 connected to the collection tube 20 of the water-filled spaces 2 of the engine, the oil cooler cooling the oil of the transmission (not shown) and a thermostat valve 11 connected to the oil cooler via pipe 12. The thermostat valve is connected via pipe 10 with the radiator 9, the discharge line of which is connected via pipe 6 with the liquid pump 5. The pressure side of the liquid pump 5 is connected via the pipe 4 with the oil cooler 3, which is connected to the water spaces 2 and which cools the lubricating oil of the combustion engine 1. The shunt pipe 8 connecting the thermostat valve 11 with the pipe 6 is connected in parallel to a part of the main operating circuit.

The side circuits arranged in parallel with various parts of the main operating circuit are formed by the vent pipes 13, 17 and 18, which are connected to the expansion tank 16 which in turn is connected via fall pipe 7 with the pipe 6. Each of the vent pipes 13,17 and 18 is provided with a throttle element 14. The expansion tank 16 is provided with a flap valve 15 allowing communication with the outer air. The vent pipes 13, 17 and 18 are connected to the geodetic high points 3*a*, 9*a* 19*a* of the cooling circuit, where the flowing cooling liquid cannot entrain the accumulated air.

Figure 2:
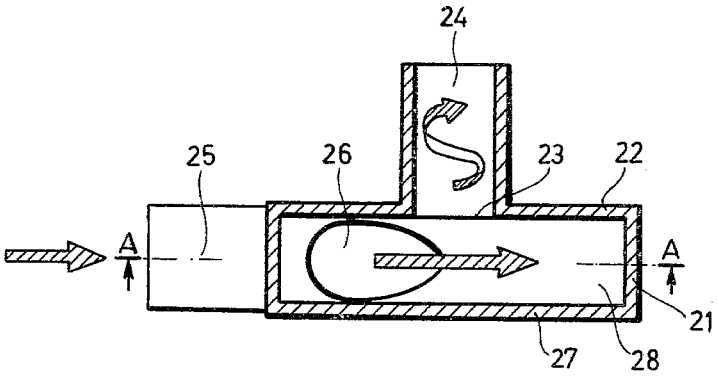
FIG. 2 is a section through an embodiment of the throttle element with constant geometric cross-section employed in the apparatus of the present invention.
Figure 3:
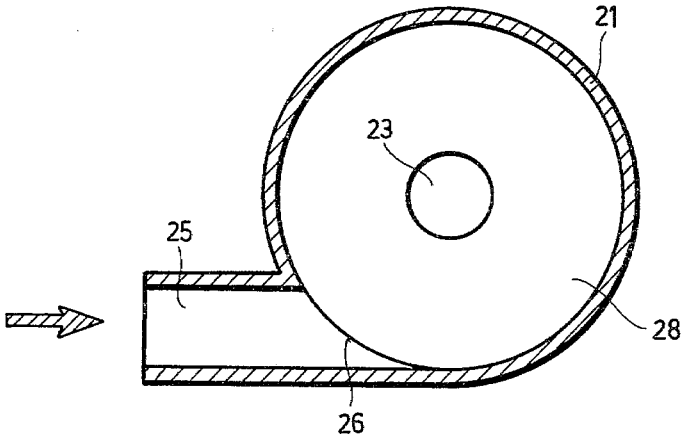
FIG. 3 is a section along the line A—A of FIG. 2.

In FIG. 2 shows a longitudinal section through an embodiment of the throttle valve 14. This so called rotation throttle 28 has a constant geometrical cross section and generates water vortexes. FIG. 3 shows a cross-section of the rotation throttle 28. An intake pipe 25 runs tangentially to the cylindrical housing 21 near the bottom 27 and forms thus the entrance cross-section 26. The exit or outlet tube 24 follows at the roof 22 of the cylindrical housing 21—preferably in a concentric arrangement—and stands vertically on the roof, the outlet tube forming the discharge cross-section 23. The capability of transmission of the rotation throttle 28 is similar to that of any hydraulic element providing the relationship $$q_v = \mu f \sqrt{\frac{2}{\rho} \Delta p}$$

wherein $q_v$=the measured volume stream, $\mu$=contraction and resistance factor f=geometrical cross-section $\rho$=density of liquid $\Delta_p$=pressure drop The geometrical cross-section f is identical with the smaller of the two cross-sections 23 and 26. The hydraulic cross-section is smaller than the geometrical cross-section and is provided by the product $\mu$f. The decrease of the hydraulic cross-section occurs in the following way: the liquid streaming in from the intake pipe 25 through the entrance cross-section 26 performs, because of its tangential influx, a rotary motion in the cylindrical housing 21, which can be conceived as a potential vortex having a core. Since the center point of the exit cross-section 23 is situated in the axis of the cylindrical housing 21, the liquid will discharge only through a part of the circular cross-section forming the exit cross-section. The venting apparatus provided with the rotation throttle has the following phases of operation: While the cooling system is filled with liquid, air flows through the rotation throttle only until liquid reaches the rotation throttle 28 via one of the geodetic high points to be vented, for example 3*a*. With air flow the flow limiting effect of the rotation throttle 28 is negligibly small, firstly because of the low density and second because of the small amount flowing per time unit through the ventilation pipe 18. Upon passing of air no vortex forms in the cylindrical housing 21 because of the small flow velocity. During filling there is thus provided an intense escape of the air.

After the filling up is finished (i.e. the allowed maximum level of the liquid is reached), a considerable amount of air remains in the cooling system, since in most cases not all so called air pockets are connected via vent pipes with the air-gathering location. This does not pose a problem, since the flow of liquid, after the engine 1 is started and the liquid pumps is put in rotation, entrains along with it a large part of the air present in the system; this air can then segregate at the vent locations.

At the same time with the starting of the engine 1 the liquid pump 5 begins to circulate the cooling liquid, the flow rate increasing also in the vent pipes 13, 17 and 18 because of the considerably increasing pressure differentials.

If one of the ventilation pipes 13, 17 and 18 contains air or vapor bubbles, these can run unimpeded through the rotation throttle 28. When liquid flows through the rotation throttle 28, a very strong throttling effect is produced and reduces considerably the amount of liquid flowing through the vent pipes 13, 17 18. This throttling arises as follows: during the running of the engine a forced flow is generated and the resulting pressure differential causes the velocity of the liquid in the ventilation pipes 13, 17 and 18 to rise. Because of this larger velocity a potential vortex is formed in the interior of the cylindrical housing 21 of the rotation throttle 28. The whirling liquid will employ a cross-section when exiting through the exit opening 23, wherein the sum of the kinetic energies of the mutually opposed straight and circular motions are minimal. Thus a core cross-section is generated through which no liquid flows. The remaining circularly shaped cross-section is only a part of the exit cross-section 23. Since the rotation throttle 28 has nowhere a cross-section, which is smaller than the cross-section of the vent pipes, the venting occurs rapidly. It is also advantageous that scale and fouling deposits cannot cause disturbances of the operation. The ventilation runs automatically and no action by man is required. The apparatus is insensitive to the position and location of its installation. An overpressure can be easily generated in the liquid pump 5 by action of the rotation throttle via the fall pipe 7 connected to the intake pipe 6 of the liquid pump 5.

Figure 4:
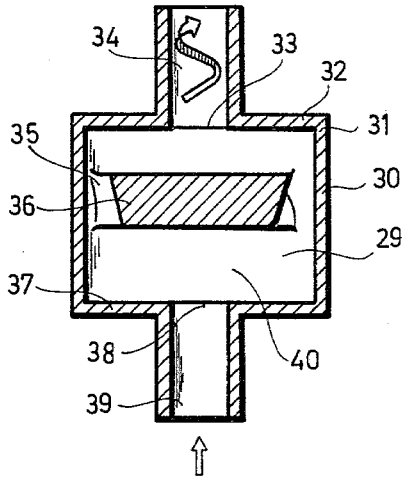
FIG. 4 is a longitudinal section through a further embodiment of the throttle element having a constant geometric cross-section and FIG. 5 shows a longitudinal section of an embodiment of the throttle element with variable geometric cross-section.

The flow restrictor 29 shown in FIG. 4 by way of a longitudinal section of the throttle element 14 comprises a vortex generating constant geometric cross-section and is provided with a whirl insert 36. The housing 40 of the rotation throttle 29 is cylindrical. At the bottom 37 of the housing of the cylindrical housing part 30 an inlet tube 39 is connected, which forms the entrance cross-section 38. At the opposite side an outlet tube 34 follows the housing cover 32 of the housing part 31 coaxial with the housing 30, advantageously coaxial with the inlet tube 33 and concentrically with respect to the housing part 31 and the outlet tube forms the exit cross-section 33. A whirl ring 36 is disposed concentrically as an insert in the cylindrical housing 40. The whirl ring 36 is disposed such that in the cylindrical housing 40 it has—seen in the direction of flow of the liquid—a lower compartment 30 and an upper compartment 31. The whirl ring 36 is provided with whirl blades 35 for the generation of a vortex motion. The rotation throttle 29 operates as follows: the liquid runs from the inlet tube 39 through the entrance cross-section 38 into the lower compartment 30 and flows from there further through the whirl ring 36 into the upper compartment of the cylindrical housing 40. After passing the whirl ring 36 the liquid forms a vortex in the upper compartment 31. The reduction of the hydraulic cross-section $\mu f$ can be derived here again from the effect discussed in connection with FIGS. 2 and 3. The liquid leaves the rotation throttle 29 through the exit cross-section 33 and the exit tube 34. Instead of the whirl ring 35 a disc having suitable bores holes can be used.

Figure 5:
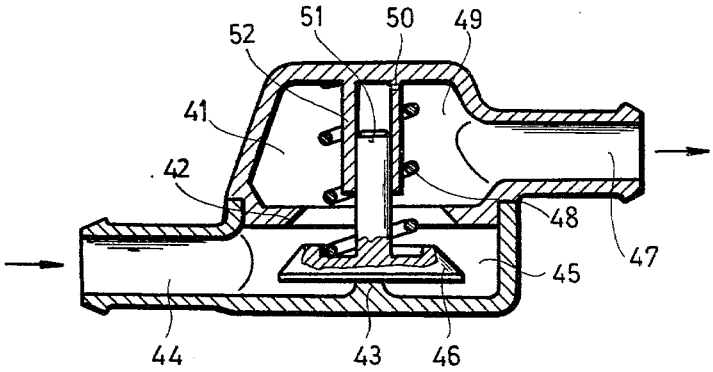

In FIG. 5 an embodiment of the throttle element is shown wherein the geometrical cross-section is variable. The throttle element 41 has a feed pipe 44 and an exit pipe 47 and its variable cross-section is generated by a valve plate 46, which in rest position is seated against the stop 43 by the action of the spring 48, whereby the valve is completely open. The flow cross-section is formed by the slot between the valve seat 42 and the valve plate 46. The valve shaft 51 of the valve plate 46 is guided in the guide 52 of the valve housing 49. The guide 52 is provided with a balancing bore hole 50 allowing communication between the inner room of the guide 52 and the outer room 49 of the throttle element 41. The throttle element 41 operates in the following fashion: as long as the throttle element 41 is passed through by air the valve plate 46 remains in open position, since the force of the prestressed spring 48 is larger then the closure force acting on the valve plate. In the case of liquid flow based on the considerably larger density of the flowing medium the difference between the static pressures increases, which prevail in the—seen in flow direction—lower room 45 located in front of the valve plate and in the upper room 49 located behind the valve plate.

Together with the pressure difference also the closure force exerted on the valve plate 46 increases. When the valve plate 46 slides in closure direction, thereby the flow cross-section f is reduced, which simultaneously means a reduction of the hydraulic cross-section $\mu f$. The valve plate 46 may only be closed completely in the upper speed range of the engine 1.

The embodiments disclosed herein serve only as an explanation and do not limit the invention in any manner. Throttle constructions operating by similar principles can be realized in a multitude of ways, for example, regarding the realization of the body (valve) disposed in the path of the flow, the kind of the force maintaining open position (for example loading with a weight) and the construction of the valve housing. Furthermore simple solutions are conceivable to avoid a complete closure, since this may be advantageous in cases of special applications.

We claim:

1. An automatic venting liquid-coolant engine-cooling system for a combustion engine of a motor vehicle, comprising:

an engine having liquid-coolant spaces, means forming a circulating path for liquid coolant connected with said spaces and a pump in said path, said path having a plurality of geodetic high points at which air can accumulate;

an expansion tank having a fall pipe connected to said pump at an intake side thereof;

respective vent pipes each connecting one of said geodetic high points to said expansion tank; and a respective variable flow throttle in each of said vent pipes provided with means affording substantially free flow of gas past the flow throttle to said expansion tank but generating a flow-throttling effect upon traversal by liquid during the forced displacement thereof by said pump, said housing having a substantially cylindrical chamber fed tangentially by an inlet pipe and provided with an outlet coaxial with the chamber and extending outwardly from the type thereof.

2. An automatic venting liquid-coolant engine-cooling system for a combustion engine of a motor vehicle, comprising:

an engine having liquid-coolant spaces, means forming a circulating path for liquid coolant connected with said spaces and a pump in said path, said path having a plurality of geodetic high points at which air can accumulate;

an expansion tank having a fall pipe connected to said pump at an intake side thereof;

respective vent pipes each connecting one of said geodetic high points to said expansion tank; and a respective variable flow throttle in each of said vent pipes provided with means affording substantially free flow of gas past the flow throttle to said expansion tank but generating a flow-throttling effect upon traversal by liquid during the forced displacement thereof by said pump, said housing being formed with a whirl-generating element imparting vortex flow to liquid traversing said chamber.

3. The system defined in claim 1 or claim 2 wherein a further vent pipe is connected from another geodetic high point to one of the first mentioned vent pipes ahead of the flow throttle thereof.

* * * * *